US011021919B2

(12) United States Patent
Zhang et al.

(10) Patent No.: US 11,021,919 B2
(45) Date of Patent: Jun. 1, 2021

(54) MUD CIRCULATION SYSTEM FOR REDUCING THE SWAB PRESSURE WHILE TRIPPING OUT

(71) Applicant: Yangtze University, Jingzhou (CN)

(72) Inventors: Feifei Zhang, Jingzhou (CN); Yidi Wang, Jingzhou (CN); Yuezhi Wang, Jingzhou (CN); Xi Wang, Jingzhou (CN); Siyang Li, Jingzhou (CN)

(73) Assignee: YANGTZE UNIVERSITY, Jingzhou (CN)

( * ) Notice: Subject to any disclaimer, the term of this patent is extended or adjusted under 35 U.S.C. 154(b) by 83 days.

(21) Appl. No.: 16/536,337

(22) Filed: Aug. 9, 2019

(65) Prior Publication Data

US 2020/0240222 A1 Jul. 30, 2020

(30) Foreign Application Priority Data

Jan. 29, 2019 (CN) ..... 201910085341.6

(51) Int. Cl.

| | |
|---|---|
| ***E21B 21/08*** | (2006.01) |
| ***E21B 21/12*** | (2006.01) |
| ***E21B 21/10*** | (2006.01) |
| ***E21B 47/22*** | (2012.01) |
| ***E21B 19/08*** | (2006.01) |
| ***E21B 21/00*** | (2006.01) |
| ***E21B 49/00*** | (2006.01) |
| ***E21B 44/02*** | (2006.01) |

(Continued)

(52) U.S. Cl.

CPC ..... *E21B 21/08* (2013.01); *E21B 21/10* (2013.01); *E21B 21/12* (2013.01); *E21B 3/02* (2013.01); *E21B 19/08* (2013.01); *E21B 21/00* (2013.01); *E21B 21/062* (2013.01); *E21B 21/082* (2020.05); *E21B 21/085* (2020.05); *E21B 21/106* (2013.01); *E21B 44/00* (2013.01); *E21B 44/02* (2013.01); *E21B 47/06* (2013.01); *E21B 47/22* (2020.05); *E21B 49/005* (2013.01)

(58) Field of Classification Search

CPC ..... E21B 21/08; E21B 21/10; E21B 21/12; E21B 19/08; E21B 47/22; E21B 49/005; E21B 21/082; E21B 21/085; E21B 21/106; E21B 21/00

See application file for complete search history.

(56) References Cited

U.S. PATENT DOCUMENTS

2003/0079912 A1* 5/2003 Leuchtenberg ..... E21B 44/00 175/38

* cited by examiner

*Primary Examiner* — Tara Schimpf
*Assistant Examiner* — Manuel C Portocarrero
(74) *Attorney, Agent, or Firm* — Hemisphere Law, PLLC; Zhigang Ma

(57) ABSTRACT

The invention provides a mud circulation system for reducing swab pressure while tripping out, including drilling tool components, a normal drilling circulation channel and a tripping circulation channel, the drilling tool components include a drill string, a drill bit, and a top drive, the normal drilling circulation channel includes a first rotary valve, a solid phase control device, a mud tank, a mud pump, and a forth rotary valve connected in sequence, the tripping circulation channel includes a second rotary valve, a tripping mud pump, a tripping mud tank and a third rotary valve connected in sequence; the mud circulation system for reducing the swab pressure is operated to: shut down the mud pump, close the first rotary valve, and open the second rotary valve and the third rotary valve before tripping out; determine the pumping flow rate according to relevant parameters.

4 Claims, 3 Drawing Sheets

(51) Int. Cl.

| | |
|---|---|
| ***E21B 44/00*** | (2006.01) |
| ***E21B 21/06*** | (2006.01) |
| ***E21B 3/02*** | (2006.01) |
| ***E21B 47/06*** | (2012.01) |

MUD CIRCULATION SYSTEM FOR REDUCING THE SWAB PRESSURE WHILE TRIPPING OUT

FIELD OF THE DISCLOSURE

The disclosure relates to a drilling engineering field, and more particularly to a mud circulation system for reducing swab pressure while tripping out.

BACKGROUND

As the exploitation and production of oil and gas moving towards deep formation and deep water region, the safe mud density window left for drilling activity becomes narrower. In narrow mud density window environment, the formation pore pressure is close to the fracture pressure. The bottom hole pressure fluctuation caused by drilling operation makes bottom hole pressure easily exceed the safe mud density window range, leading to complex accidents such as overflow or loss of circulation.

Bottom hole pressure fluctuation is mainly affected by the tripping speed, well depth, drilling fluid density, drilling fluid consistency, drilling fluid rheology, bit depth and so on. The severity of the swab pressure increases as any of the following parameter increases, which includes the tripping speed, the viscosity of drilling fluid, the density of drilling fluid, the well depth, the bit depth.

The existing method of reducing the swab pressure is to reduce the tripping speed while tripping out, especially in the early stage of the tripping activity. The maximum allowed tripping speed decreases as the bit depth increases. This results in long tripping time for deep, ultra-deep and extended reach horizontal wells, which increases the time cost of drilling, extends the exposure time of open hole section and increases the risk of borehole instability.

Based on the discussion above, it is extremely useful to find a way to reduce the swab pressure while tripping out which does not need to reduce the tripping speed, especially in deep wells and extended reach wells. The new approach can reduce the accident risk in the process while tripping out, reduce the tripping time, therefore, reduce the drilling cost, especially in deep wells and extended reach wells.

SUMMARY

A technical problem to be solved by the disclosure is to provide a mud circulation system that can enhance drilling safety, reduce accident risk, and reduce drilling time and drilling cost.

A mud circulation system for reducing swab pressure while tripping out, including drilling tool components, a normal drilling circulation channel and a tripping circulation channel, wherein: the drilling tool components include a drill bit, a drill string and a top drive, the drill bit is fixed on the bottom end of the drill string, and the top drive is fixed on the top end of the drill string, the drill bit is used to drill the formation rock, the drill string is used to rotate the drill bit as well as to transport the mud from the ground to well bottom, the top drive is used to rotate the drill string; the normal drilling circulation channel includes a first rotary valve, a solid phase control device, a mud tank, a mud pump, and a forth rotary valve connected in sequence, the first rotary valve is connected with the annulus by a pipe, the solid phase control device is used to eliminate the solid particles in the mud, the inlet of the mud pump is connected with the mud tank, while the outlet of the mud pump is connected with the forth rotary valve, and the forth rotary valve is connected to the drill string; the tripping circulation channel includes a second rotary valve, a tripping mud pump, a tripping mud tank and a third rotary valve connected in sequence, the second rotary valve is connected with the drill string, the tripping mud pump is used to drive the mud in the tripping mud tank to flow into the drill string, the third rotary valve is connected with the annulus by a pipe.

The method to operate the mud circulation system for reducing the swab pressure is as follows: step S11 shutting down the mud pump, closing the first rotary valve and the forth rotary valve, and opening the second rotary valve and the third rotary valve before tripping out; step S12 determining the pumping flow rate while tripping out according to relevant parameters, which include the tripping speed, parameters related to the drill string, parameters related to the wellbore and the annulus, and parameters related to the mud; step S13 starting the tripping mud pump so that the pumping flow rate gradually reaches and stabilizes the pumping flow rate value determined in step S12.

The pumping flow rate described in step S12 is determined by the following method: step S21 estimating a pumping flow rate for initial guess; step S22 calculating the wellbore pressure according to relevant parameters including the tripping speed, parameters related to the drill string, parameters related to the wellbore and the annulus, and parameters related to the mud, the wellbore pressure is calculated by the following method: firstly, determining the flow regime of the mud as laminar or turbulent flow by using a general Reynolds number because most of the drilling fluids are non-Newtonian, then based on the type of the mud flow regime, choosing the corresponding method to calculate the wellbore pressure caused by frictional term, and then calculating the wellbore pressures caused by gel effect and inertial effect, finally, calculating the total wellbore pressure by adding the wellbore pressures caused by the frictional effect, the inertial effect and the gel effect; step S23 compare the total wellbore pressure obtained in step S22 with a preset safe wellbore pressure range, if the total wellbore pressure is higher than the upper limit of the safe wellbore pressure range, reducing the estimated pumping flow rate and repeating steps S21-S23, if the total wellbore pressure is lower than the lower limit of the safe wellbore pressure range, increasing the estimated pumping flow rate and repeating steps S21-S23, if the total wellbore pressure is within the safe wellbore pressure range, using the estimated pumping flow rate as the determined value of the pumping flow rate.

The beneficial effect of the technical scheme proposed in the present invention is: by adding an additional tripping mud circulation loop to the conventional mud circulation system, and using the tripping mud circulation loop while tripping, and by determining the pumping flow rate according to relevant parameters, including the tripping speed, parameters related to the drill string, parameters related to the wellbore and the annulus, and parameters related to the mud, the swab pressure while tripping out can be effectively reduced, the risk of wellbore instability and the drilling time are reduced, and therefore the expense of drilling is reduced.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Figure 1:
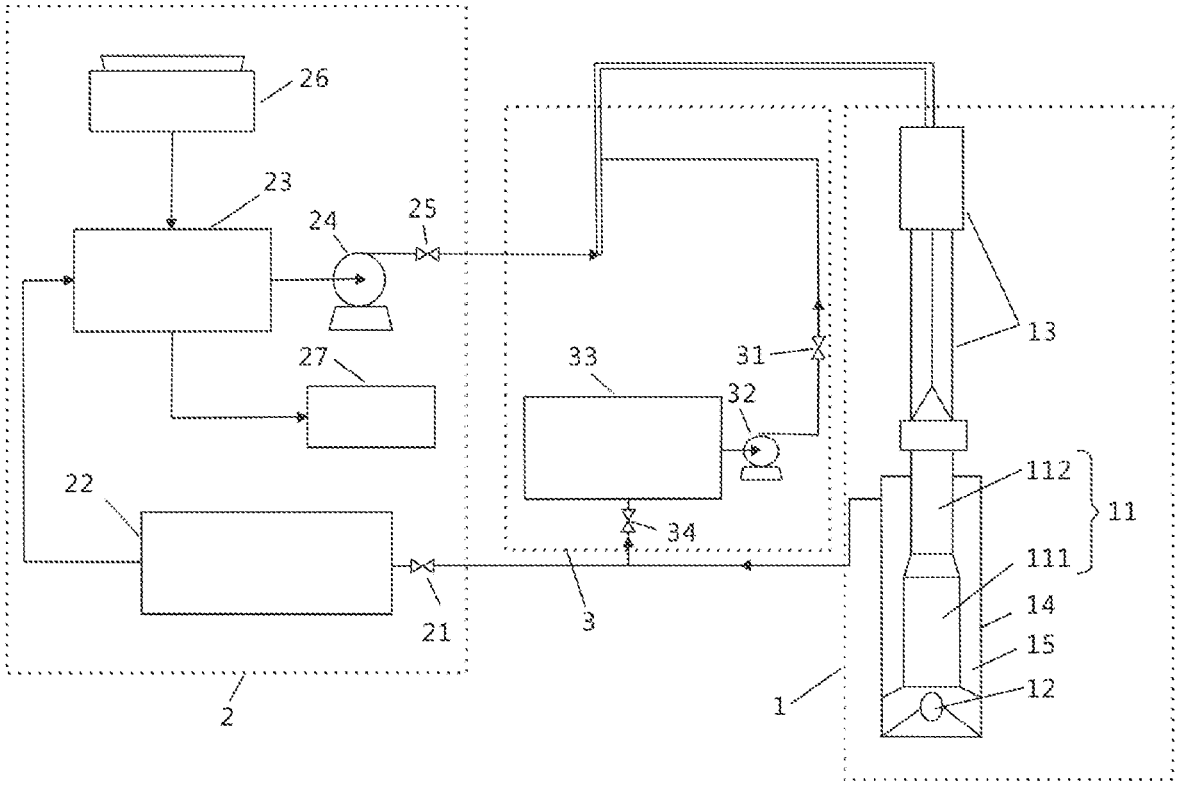
FIG. 1 is a schematic diagram of the mud circulation system.

As illustrated in FIG. 1, the invention provides a mud circulation system for reducing the swab pressure while tripping out, including: drilling tool components 1, a normal drilling circulation channel 2 and a tripping circulation channel 3.

The drilling tool components 1 include a drill string 11, a drill bit 12, and a top drive 13. The drill bit 12 is fixed on the bottom end of the drill string 11, and the top drive 13 is fixed on the top end of the drill string 11. The drill bit 12 is used to drill the formation rock, the drill string 11 is used to rotate the drill bit 12 as well as to transport the mud from the ground to well bottom. The top drive 13 is used to rotate the drill string 11. The drill string 11 is used to transport the mud from the ground to well bottom. An annulus 15 is formed between the wellbore wall 14 and the outer wall of the drill string 11. The annulus 15 is used to provide an access for the mud from the well bottom to the near surface of the wellbore. The drill string 11 includes a drill collar 111 and at least one drill pipe 112 connected in sequence, the drill collar 111 is connected with the drill bit 12 and is used to drive the drill bit 12 to rotate, the drill pipe 112 is connected with the top drive 13, and is used to drive the drill collar 111 to rotate, the top drive 13 is used to drive the drill pipe 112 to rotate.

The normal drilling circulation channel 2 includes a first rotary valve 21, a solid phase control device 22, a mud tank 23, and a mud pump 24 connected in sequence, the first rotary valve 21 is connected with the annulus 15 by a pipe, the solid phase control device 22 is used to eliminate the solid particles in the mud, the inlet of the mud pump 24 is connected with the mud tank 23, while the outlet of the mud pump 24 is connected with the forth rotary valve 25, and the forth rotary valve is connected with the drill string 11. In this embodiment, the forth rotary valve 25 is connected with the drill pipe 112 by a pipe. The normal drilling circulation channel 2 also includes a mud mixing tank 26 and a waste mud treating tank 27. The mud mixing tank 26, which is connected with the mud tank 23, is used to add some mixture to the mud tank 23. The waste mud treating tank 27, which is connected with the mud tank 23, is used to collect and treat the waste mud.

The tripping circulation channel 3 includes a second rotary valve 31, a tripping mud pump 32, a tripping mud tank 33 and a third rotary valve 34 connected in sequence. The second rotary valve 31 is connected with the drill string 11. The tripping mud pump 32 is used to drive the mud in the tripping mud tank 33 to flow into the drill string 11. The third rotary valve 34 is connected with the annulus 15 by a pipe.

During normal drilling operation, opening the first rotary valve 21 and the forth rotary valve 25, starting the mud pump 24, and closing the second rotary valve 31 and the third rotary valve 34. In this situation, the tripping circulation channel 3 is in the closed state, while the normal drilling circulation channel 2 is in the opened state. The normal drilling circulation channel 2, the drilling tool components 1, and the annulus 15 together form a complete mud circulation loop. Specifically, the mud pump 24 drive the mud in the mud tank 23 through the pipe and the drill string 11 to the well bottom. With the continuous injection of the mud, the annulus 15 is gradually filled with mud, at which point the mud will flow into the solid phase control device 22. At the same time, as the drill bit drills into the formation rock, it produces a large amount of cuttings, which flow into the solid phase control device 22 with the mud. The solid phase control device 22 removes the cuttings from the mud and transfers the treated mud back into the mud tank 23, thus forming a complete mud circulation loop.

During the tripping operation, swab pressure will form in the wellbore, which increases the risk of wellbore instability. The method to reduce the swab pressure through this mud circulation system is: S11 Before the tripping operation, shutting down the mud pump 24, closing the first rotary valve 21 and the forth rotary valve 25, and opening the second rotary valve 31 and the third rotary valve 34; S12 Determining the pumping flow rate of the tripping mud pump according to relevant parameters, which include: tripping speed, drilling depth, mud related parameters (such as: mud density, mud viscosity, colloidal strength of mud, mean fluid velocity), wellbore and annulus related parameters (such as: borehole diameter, inner and outer diameter of annulus, annulus hydraulic diameter, annulus cross section area, annulus wetted perimeter,) and drill string related parameters (such as: inner and outer diameter of drill string and drill string friction coefficient); S13 Starting the tripping mud pump so that the pumping flow rate gradually reaches and stabilizes the pumping flow rate value determined in step S12; S14 starting tripping out the drill string until the top drive reaches the highest position; S15 stopping the tripping pump, then disconnecting the tripped out stand string component from the drill string, returning the top drive to the rig floor level, and connecting the top drive to the remaining drill string in the wellbore; S16 repeating S13 to S15 to trip out the next stand of the drill string.

Figure 2:
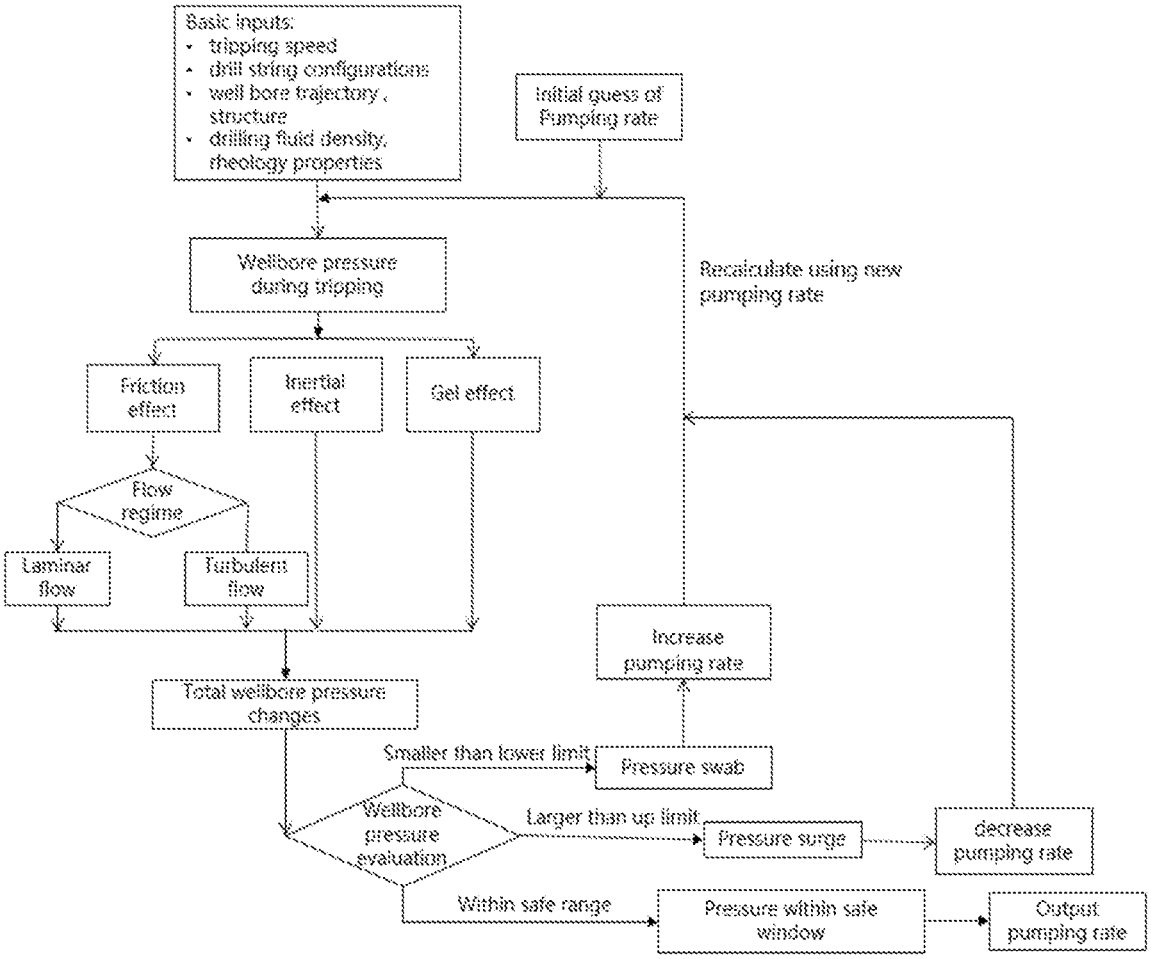
FIG. 2 is a flowchart of a method for determining the pumping flow rate.

As illustrated in FIG. 2, the pumping flow rate described in step S12 is determined by the following method: S21 Estimating a pumping flow rate for initial guess; S22 Calculating the wellbore pressure according to relevant parameters including the tripping speed, parameters related to the drill string, parameters related to the wellbore and the annulus, and parameters related to the mud, the wellbore pressure is calculated by the following method: firstly, determining the flow regime of the mud as laminar or turbulent flow by using a general Reynolds number because most of the drilling fluids are non-Newtonian, then based on the type of the mud flow regime, choosing the corresponding method to calculate the wellbore pressure caused by frictional term, and then calculating the wellbore pressure caused by gel effect and inertial effect, finally, calculating the total wellbore pressure by adding the wellbore pressures caused by the friction effect, the inertia effect and the gel effect; S23 Comparing the total wellbore pressure obtained in step S22 with a preset safe wellbore pressure range, if the total wellbore pressure is higher than the upper limit of the safe wellbore pressure range, reducing the estimated pumping flow rate and repeating steps S21-S23, if the total wellbore pressure is lower than the lower limit of the safe wellbore pressure range, increasing the estimated pumping flow rate and repeating steps S21-S23, if the total wellbore pressure is within the safe wellbore pressure range, using the estimated pumping flow rate as the determined value of the pumping flow rate.

The calculation method of total wellbore pressure in step S22 is as follows: The total wellbore pressure is affected by three factors: frictional effect, inertial effect and gel effect. The wellbore pressures caused by the frictional effect, the inertial effect and the gel effect are added together to calculate the total wellbore pressure. These three effects are described in detail below.

Frictional Effect

Mud fluid has two types of flow regime: laminar or turbulent flow. Since most mud fluids are non-Newtonian fluids, their flow regime can be determined by the following general Reynolds formula:

$$Re = \frac{8^{1-N}\rho v^{2-N} D_H^N}{K}$$

$$D_H = \frac{4A}{P}$$

wherein, Re is general Reynolds number, N is the fluid behavior index, ρ is mud density, v is mean mud velocity, $D_H$ is hydraulic diameter, K is mud consistency coefficient, A is cross section area, P is annulus wetted perimeter, if Re>2300, it is turbulent flow, if Re≤2300, it is laminar flow.

Case 1: the flow regime of the annular mud fluid is laminar flow.

The fluid flow in annulus may have three possible conditions, which are depended on the tripping speed and pumping flow: (a) $Q_{pumping}>Q_{displaced}$ ($Q_{pumping}$ is the pumping flow, $Q_{displaced}$ is the equivalent flow of drill string displacement, $Q_{displaced}$ is positive while tripping in and negative while tripping out), the average velocity direction is the same as the tripping direction; (b) $Q_{pumping}=Q_{displaced}$, the average velocity is zero; (c) $Q_{pumping}<Q_{displaced}$, the average velocity direction is opposite to the tripping direction. The velocity distribution in different regions is shown in FIG. 3.

Figure 3:
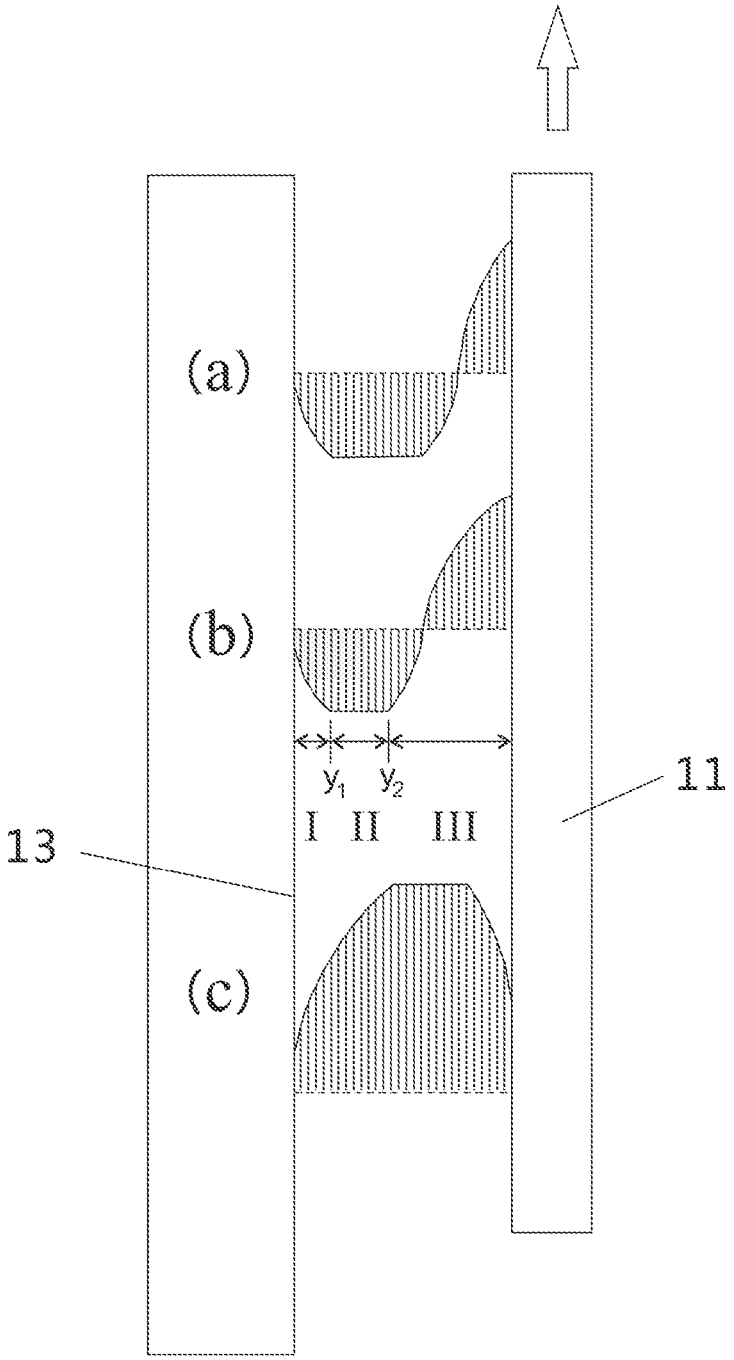
FIG. 3 is a schematic diagram of annular velocity distribution while tripping out.

As illustrated in FIG. 3, based on the flow characteristics of mud fluid, the mud flow in the annulus can be divided into three regions—Region I, Region II and Region III, of which, Region II is the core flow region, where the velocity of mud flow is the same.

For the two cases (a) and (b) in FIG. 3, the velocity distribution of each region can be expressed as:

Region I:

$$\tilde{v}_I=\pi_1[(\tilde{y}_1-\tilde{y})^b-\tilde{y}_1^{\,b}]\quad 0\le\tilde{y}\le\tilde{y}_1 \tag{1}$$

Region II:

$$\tilde{v}_{II}=\tilde{v}_1(\tilde{y}_1)\quad \tilde{y}_1\le\tilde{y}\le\tilde{y}_2 \tag{2}$$

Region III:

$$\tilde{v}_{III}=1-\pi_1[(1-\tilde{y}_1)^b-(\tilde{y}-\tilde{y}_2)^b]\quad \tilde{y}_2\le\tilde{y}\le 1 \tag{3}$$

wherein:

$$\pi_1 = \frac{N}{N+1}\left(\frac{H}{v_p}\right)\left(\frac{\Delta P}{\Delta L}\frac{K}{H}\right)^{\frac{1}{N}} \tag{4}$$

$$b = \frac{N+1}{N};\ \tilde{v}_1 = \frac{v_1}{v_p};\ \tilde{v}_2 = \frac{v_2}{v_p};\ \tilde{y}_1 = \frac{y_1}{H};\ \tilde{y}_2 = \frac{y_2}{H} \tag{5}$$

wherein $y_1$ and $y_2$ are the distance values of the distinguishing points of velocity transform, H is the distance from the drill string to the borehole wall, $v_p$ is the tripping velocity, N is the fluid behavior index, K is the consistency index of the drilling fluid, $$\frac{\Delta P}{\Delta L}$$

is the pressure gradient.

For the case (c) in in FIG. 3, the velocity profile of each region can be expressed as:

Region I:

$$\tilde{v}_I=\pi_1[\tilde{y}_1^{\,b}-(\tilde{y}_1-\tilde{y})^b]\quad 0\le\tilde{y}\le\tilde{y}_1 \tag{6}$$

Region II:

$$\tilde{v}_{II}=\tilde{v}_1(\tilde{y}_1)\quad \tilde{y}_1\le\tilde{y}\le\tilde{y}_2 \tag{7}$$

Region III:

$$\tilde{v}_{III}=1+\pi_1[(1-\tilde{y}_1)^b-(\tilde{y}-\tilde{y}_2)^b]\quad \tilde{y}_2\le\tilde{y}\le 1 \tag{8}$$

The thickness of the core flow region can be expressed as:

$$\tilde{y}_2 - \tilde{y}_1 = \tilde{\alpha} = \frac{2\tau_0/H}{\Delta P/\Delta L} \tag{9}$$

The fluid velocity at $y=y_1$ and $y=y_2$ should be equal. Combining the formulas, we can get that:

$$(1-\tilde{y}_1-\pi_2)^b-(\tilde{y}_1)^b-\frac{1}{\pi_1}=0 \tag{10}$$

Similarly, for the cases (a) and (b) shown in FIG. 3, the formulas are combined to obtain:

$$(1-\tilde{y}_1-\pi_2)^b-(\tilde{y}_1)^b+\frac{1}{\pi_1}=0 \tag{11}$$

The total flow is the sum of regional flows:

$$Q_t=2\pi W\int_0^H v(y)dy==2\pi W[\int_0^{y_1} v_I(y)dy+\int_{y_1}^{y_2} v_{II}(y)dy+\int_{y_2}^{H} v_{III}(y)dy] \tag{12}$$

wherein $Q_t$ is the total flow, W is the system width parameter, which can be estimated by using the average of the outer diameter of the drill string pipe $D_p$ and the inner diameter of the wellbore $D_w$.

Detailed procedures for the calculations are shown below: S31 Calculating the total flow rate in the annulus by the following formula: $Q_t=VA$, wherein $Q_t$ is the total flow rate in the annulus, V is the tripping speed, and A is the cross section area; S32 Guessing a pressure gradient $$\frac{\Delta P}{\Delta L}$$

caused by the frictional term; S33 Transferring all the parameters dimensionless by formulas (4) and (5); S34 Judging whether the total flow rate in the annulus is less than zero, if yes, obtaining $\tilde{y}_1$ by formula (10), then substituting $\tilde{y}_1$ into formulas (6)-(8) to obtain $\tilde{v}_1$, $\tilde{v}_2$ and $\tilde{v}_3$, otherwise, obtaining $\tilde{y}_1$ by formula (11), then substituting $\tilde{y}_1$ into formulas (1)-(3) to obtain $\tilde{v}_1$, $\tilde{v}_2$ and $\tilde{v}_3$; S35 Calculating the guessed total flow rate in the annulus by formula (12); S36 Comparing the real flow rate $Q_t$ and the guessed flow rate $Q_{t_guess}$, if the difference is larger than tolerance, going back to step S32 and changing the pressure gradient, and then repeating steps S32-S36. Otherwise, the system gets converged and outputs the pressure gradient.

Case 2: the flow regime of the annular mud fluid is turbulent flow.

In turbulent conditions, the friction pressure gradient is obtained by considering both the drill string movement and the fluid flow itself.

The friction loss in annulus with two fixed walls can be expressed as follows:

$$\frac{DP}{DL} = \frac{\rho f}{2g(d_0^2 - d_i^2)}\left\{d_i f_i\left(\frac{Q}{A}\right)\left|\frac{Q}{A}\right| + d_0 f_0\left(\frac{Q}{A}\right)\left|\frac{Q}{A}\right|\right\}$$

wherein $d_i$ is the inner diameter of annulus and $d_0$ is the outer diameter, $f_i$ is the friction coefficient on the drill string, $f_o$ is the friction coefficient on the wellbore wall, g is the gravity acceleration, Q is the flow rate, A is the cross section area of the flow conduit, and ρ is drilling fluid density. The friction factor f can be obtained through the Dodge and Metzner model.

During the actual trip, the drill pipe is moving, and the formula can be changed to an annular with moving inner wall and fixed outer wall, and the friction loss can be expressed as follows:

$$\frac{DP}{DL} = \frac{\rho f}{2g(d_0^2 - d_i^2)}\left\{d_i f_i\left(\frac{Q}{A} + V\right)\left|\frac{Q}{A} + V\right| + d_0 f_0\left(\frac{Q}{A}\right)\left|\frac{Q}{A}\right|\right\}$$

wherein $d_i$ is the inner diameter of annulus and $d_0$ is the outer diameter, $f_i$ is the friction coefficient on the drill string, $f_o$ is the friction coefficient on the wellbore wall, g is the gravity acceleration, Q is the flow rate, A is the cross section area of the flow conduit, ρ is drilling fluid density, and V is the tripping speed.

Inertial Effect

The component of inertial pressure fluctuation is caused by the tendency of mud column resisting the change of movement. It can be expressed in the following ways:

For closed end pipe:

$$\frac{\Delta P}{\Delta L} = \frac{\rho \alpha_p D_p^2}{g(D_w^2 - D_p^2)}$$

The wellbore belongs to an open end pipe. For open end pipe:

$$\frac{\Delta P}{\Delta L} = \frac{\rho \alpha_p (D_p^2 - D_i^2)}{g(D_w^2 - D_p^2 + D_i^2)}$$

wherein ρ is drilling fluid density; $a_p$ is acceleration; $D_p$ is external diameter of drilling tool; $D_i$ is internal diameter of drilling tool; $D_w$ is borehole diameter.

Gel Effect

The calculation formula for the pressure required to start the fluid circulation is as follows:

the pressure in the annulus:

$$\frac{\Delta P}{\Delta L} = \frac{4\zeta}{(D_w - D_p)}$$

wherein $D_p$ is the external diameter of drilling tool, $D_w$ is borehole diameter, ζ is the gel strength of drilling fluid, that is, the strength to be overcome before the static mud flows.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mud circulation system for reducing swab pressure while tripping out, including drilling tool components, a normal drilling circulation channel and a tripping circulation channel, wherein:

the drilling tool components include a drill bit, a drill string and a top drive, the drill bit is fixed on a bottom end of the drill string, and the top drive is fixed on a top end of the drill string, the drill bit is used to drill a formation rock, the drill string is used to rotate the drill bit as well as transport the mud from a ground to well bottom, the top drive is used to rotate the drill string;

the normal drilling circulation channel includes a first rotary valve, a solid phase control device, a mud tank, and a mud pump connected in sequence, the first rotary valve is connected with an annulus by a pipe, the solid phase control device is used to eliminate a plurality of solid particles in the mud, an inlet of the mud pump is connected with the mud tank, an outlet of the mud pump is connected with drill string;

the tripping circulation channel includes a second rotary valve, a tripping mud pump, a tripping mud tank and a third rotary valve connected in sequence, the second rotary valve is connected with the drill string, the tripping mud pump is used to drive the mud in the tripping mud tank to flow into the drill string, the third rotary valve is connected with the annulus by the pipe;

the mud circulation system for reducing swab pressure is operated to:

shut down the mud pump, close the first rotary valve, and open the second rotary valve and the third rotary valve before tripping out;

determine a pumping flow rate while tripping out according to relevant parameters, which include a tripping speed, parameters related to the drill string, parameters related to a wellbore and the annulus, and parameters related to the mud;

start the tripping mud pump so that the pumping flow rate gradually reaches and stabilizes the pumping flow rate value;

wherein, the pumping flow rate is determined by estimating the pumping flow rate for initial guess;

calculating wellbore pressures according to relevant parameters includes the tripping speed, parameters related to the drill string, parameters related to the wellbore and the annulus, and parameters related to the mud, the wellbore pressure is calculated by firstly, determining a flow regime of the mud as laminar or turbulent flow by using a general Reynolds number because most of a plurality of drilling fluids are non-Newtonian, then according to a type of the mud flow regime, calculating the wellbore pressures caused by a frictional effect, frictional term, a gel effect, and an inertial effect, finally, calculating a total wellbore pressure by adding the wellbore pressures caused by the frictional effect, the inertial effect and the gel effect;

comparing the obtained total wellbore pressure with a preset safe wellbore pressure range, if a total wellbore pressure is higher than an upper limit of the safe wellbore pressure range, reducing the estimated pumping flow rate until the total wellbore pressure is within the safe wellbore pressure range, if the total wellbore pressure is lower than a lower limit of the safe wellbore pressure range, increasing the estimated pumping flow rate until the total wellbore pressure is within the safe wellbore pressure range, if the total wellbore pressure is within the safe wellbore pressure range, using the estimated pumping flow rate as the determined value of the pumping flow rate.

2. The mud circulation system according to claim 1, wherein the drill string includes a drill collar and at least one drill pipe connected in sequence, the drill collar is connected with the drill bit and is used to drive the drill bit to rotate, the drill pipe is connected with the top drive, and is used to drive the drill collar to rotate, the top drive is used to drive the drill pipe to rotate.

3. The mud circulation system according to claim 1, wherein the normal drilling circulation channel also includes a mud mixing tank, the mud mixing tank, which is connected with the mud tank, is used to add some mixture to the mud tank.

4. The mud circulation system according to claim 1, wherein the normal drilling circulation channel also includes a waste mud treating tank, the waste mud treating tank, which is connected with the mud tank, is used to collect and treat the waste mud.

* * * * *